United States Patent [19]

Raabe et al.

[11] 4,034,170

[45] July 5, 1977

[54] ELECTRICAL TRANSFER SWITCHING APPARATUS HAVING DOOR INTERLOCK AND PLURAL SWITCH INTERLOCK

[75] Inventors: Rodney Dean Raabe; Ardie Reinhard Dittberner, both of Mankato, Minn.

[73] Assignee: General Electric Company, New York, N.Y.

[22] Filed: Jan. 21, 1976

[21] Appl. No.: 651,044

[52] U.S. Cl. ..... 200/50 A; 200/5 E; 200/50 C; 200/330; 200/337

[51] Int. Cl.² ..... H01H 9/20

[58] Field of Search ..... 200/5 R, 5 E, 5 B, 6 R, 200/18, 50 A, 50 C, 330, 337; 74/104, 107, 471 R

[56] References Cited

UNITED STATES PATENTS

| | | | |
|---|---|---|---|
| 2,370,039 | 2/1945 | Iglehart et al. | 200/5 |
| 2,531,157 | 11/1950 | Pifke | 74/483 X |
| 3,069,518 | 12/1962 | Soos | 200/50 C X |
| 3,369,100 | 2/1968 | Kussy et al. | 200/50 C |
| 3,767,872 | 10/1973 | Whitchurch | 200/50 C |

*Primary Examiner*—James R. Scott
*Attorney, Agent, or Firm*—Robert A. Cahill; Walter C. Bernkopf; Frank L. Neuhauser

[57] ABSTRACT

Switching apparatus for switching an electrical load between alternative sources of electrical power includes a pair of switches having their load terminals connected in common to the load and their line terminals respectively connected to the two sources. The mechanisms of the switches are interconnected by a reciprocating slide which is manipulated such as to connect one or the other, but never both of the sources to the load.

7 Claims, 4 Drawing Figures

ELECTRICAL TRANSFER SWITCHING APPARATUS HAVING DOOR INTERLOCK AND PLURAL SWITCH INTERLOCK

BACKGROUND OF THE INVENTION

With the ever increasing reliance on electrical power in homes and industry, power outages caused by breakdowns in electrical utility equipment become, at the very least, extremely aggravating. It is for this reason, plus the frequency of disruptions in utility electrical service, that standby generating equipment to supply at least critical load circuits has become popular. To accommodate these alternative electrical sources supplying common electrical load circuits, a so-called power transfer switch is utilized. This transfer switch normally is conditioned to connect the utility source to the common load circuits, while maintaining the standby generating equipment disconnected therefrom. Upon the occurrence of a power outage, the transfer switch is reconditioned either automatically or manually to first disconnect the utility source and then connect the standby source to the common load circuits. Obviously, precaution must be taken to insure that the two sources can never be simultaneously connected to the common load circuits.

Transfer switches serving this end have typically been quite expensive, complicated in design, and difficult to operate. It is therefore a principal object of the present invention to provide an improved transfer switch which is simple in design, convenient and reliable in operation, and inexpensive to manufacture.

SUMMARY OF THE INVENTION

In accordance with the present invention, there is provided transfer switching apparatus for switching an electrical load between alternative sources of electrical power, for example, a normal utility source and standby electrical generating equipment. The apparatus includes a pair of switches mounted in an enclosure with their load terminals connected in common to an electrical load. The line terminals of one switch are connected to the utility source, while the line terminals of the other are connected to the standby source. The operating mechanisms of both switches are interconnected by a reciprocating slide accessible externally of the enclosure for convenient manipulation. The interconnection between each switch operating mechanism and the slide is a simple pin-slot interconnection. That is, an eccentric pin associated with each switch operating mechanism operates in a separate, unique, L-shaped slot having a longitudinally elongated segment and a transversely elongated segment. Starting from the condition where the slide is in its neutral position, i.e., both switches open, if the slide is moved longitudinally in one direction, the pin for one slot moves in the transverse slot segment causing this switch to be cranked into its closed circuit condition. The pin for the other switch moves in the longitudinal segment of its slot and thus the mechanism of this switch is not cranked; its contacts remaining open. During longitudinal return movement of the slide to its neutral position, the pin for the one switch again moves in the transverse segment of its slot to crank its switch operating mechanism in the opposite direction and open its contacts. The pin for the other switch simply moves in the longitudinal segment of its slot and thus the contacts for the other switch are not actuated as the slide returns to its neutral position.

Longitudinal movement of the slide in the opposite direction from its neutral position simply reverses the operation with the other switch being cranked to its closed or ON condition, while the one switch is not cranked and it remains open or OFF.

The switches are mounted in an enclosure having a frontal door. A catch carried by the door is engaged by the slide while the latter is removed from its neutral position to preclude access to the interior of the enclosure. However, upon assuming its neutral position, the slide disengages the catch to permit opening of the door for servicing and maintenance of the enclosed components in relative safety.

As an additional feature of the invention, additional L-shaped slots are provided in the slide for receipt of the pins such as to reverse the operations of the switches for a given direction of slide movement.

The invention accordingly comprises the features of construction and arrangement of parts which will be exemplified in the construction hereinafter set forth, and the scope of the invention will be indicated in the claims.

BRIEF DESCRIPTION OF THE DRAWINGS

For a better understanding of the nature and objects of the invention, reference should be had to the following detailed description taken in conjunction with the accompanying drawings, in which.

Corresponding reference numerals refer to like parts throughout the several views of the drawings.

DETAILED DESCRIPTION

Figure 1:
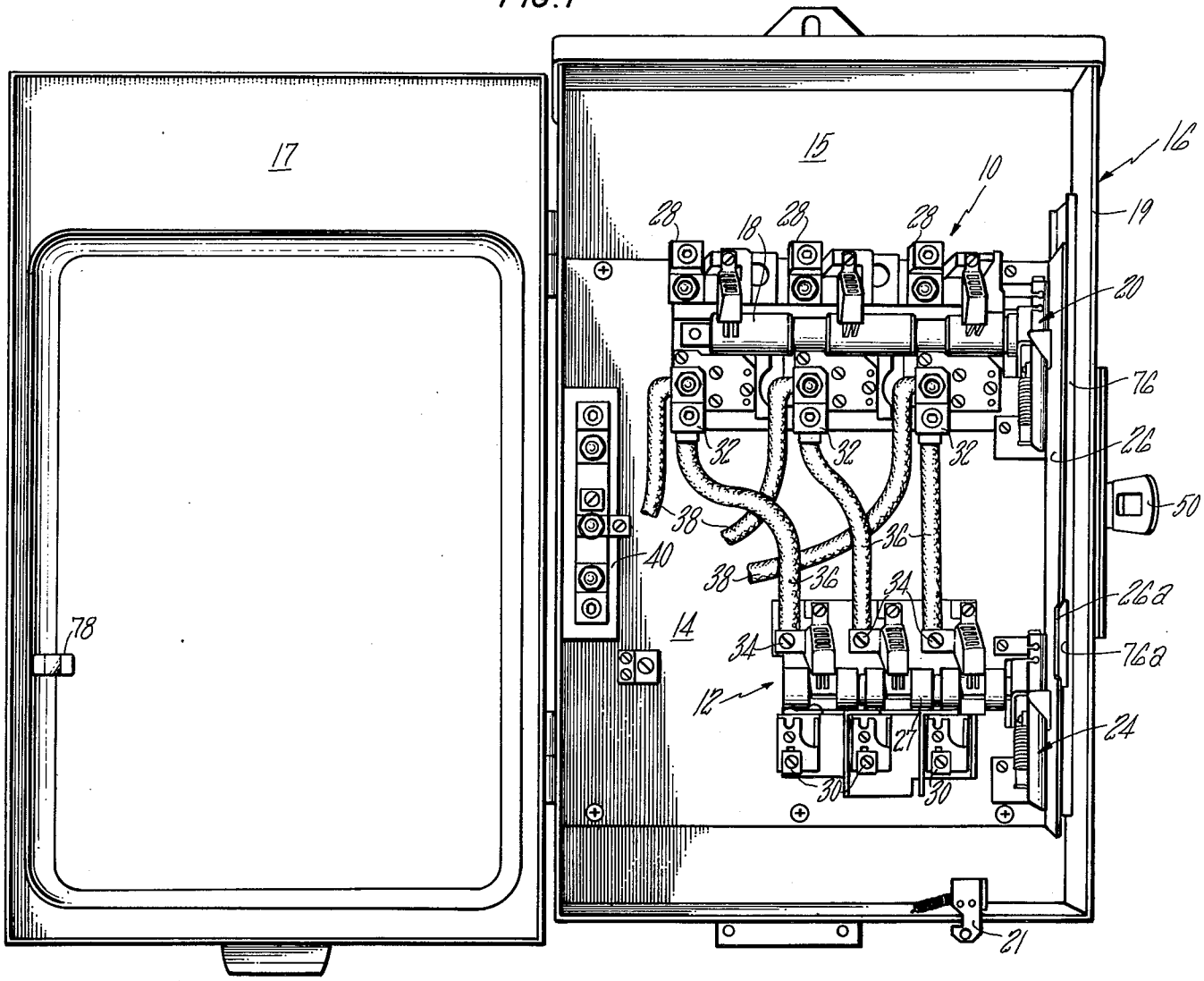
FIG. 1 is a front elevational view of the transfer switching apparatus of the present invention.

The transfer switching apparatus of the present invention includes, as seen in FIG. 1, a pair of electrical switches, generally indicated at 10 and 12, which are affixed to a common mounting pan 14, in turn mounted to the backwall 15 of an enclosure, generally indicated at 16. The enclosure is equipped with a side hinged front door 17 releasably held closed by a latch 21. The switches are illustrated as having three poles, however, it will be understood, particularly in light of the following description, that the number of switching poles has no bearing on the instant invention. Moreover, these switches, while shown as rotor type switches, such as disclosed in U.S. Pat. No. 3,202,775, may be pivotal type switches such as disclosed in U.S. Pat. No. 3,211,867. In switches of both types, their movable contacts move in an arcuate path between open and closed circuit positions. For want of a better term, the operating mechanisms for articulating the movable contacts of both types of electrical switches will hereinafter be referred to as rotary operating mechanisms.

The rotary operating mechanism of switch 10 includes a rotor 18 mounting a pair of contact blades (not shown) for each pole which make and break with corresponding pairs of stationary contacts (not shown). The right end of rotor 18 is coupled to a spring-powered, quick-make, quick-break mechanism, generally indicated at 20; such mechanism being of well-known construction as typified by the disclosure of U.S. Pat. No. 2,457,497. Similarly, switch 12 includes a rotor 22 mounting pairs of contact blades which make and break with corresponding pairs of stationary contacts in double-break fashion. The right end of rotor 22, seen in FIG. 1, is also coupled to a quick-make, quick-break mechanism 24, which, with its counterpart mechanism 20, is mounted to a forwardly extending flange 26 integrally formed with pan 14.

Switch 10 further includes line terminals 28, one for each switch pole, for connection to the normal or utility source of electrical power. Switch 12 further includes line terminals 30 for connection to a standby electrical source, typically in the form of portable generating equipment. As illustrated in FIG. 1, switch 12 can be of a smaller size and thus a lower current rating than switch 10 in view of the limited current generating capacity of the standby source as compared to the normal or utility source, although the two switches may be of equal size and rating. The corresponding load terminals 32 of switch 10 and load terminals 34 of switch 12 are connected in common by cables 36. The common swtich load terminals are connected by cables 38 to the electrical loads served either from the normal source or the standby source depending upon which of the switches 10, 12 is closed. Included within enclosure 16 is a neutral bar multiple connector 40 to which the neutral return conductors of the two sources and the common load are connected.

Figure 2:
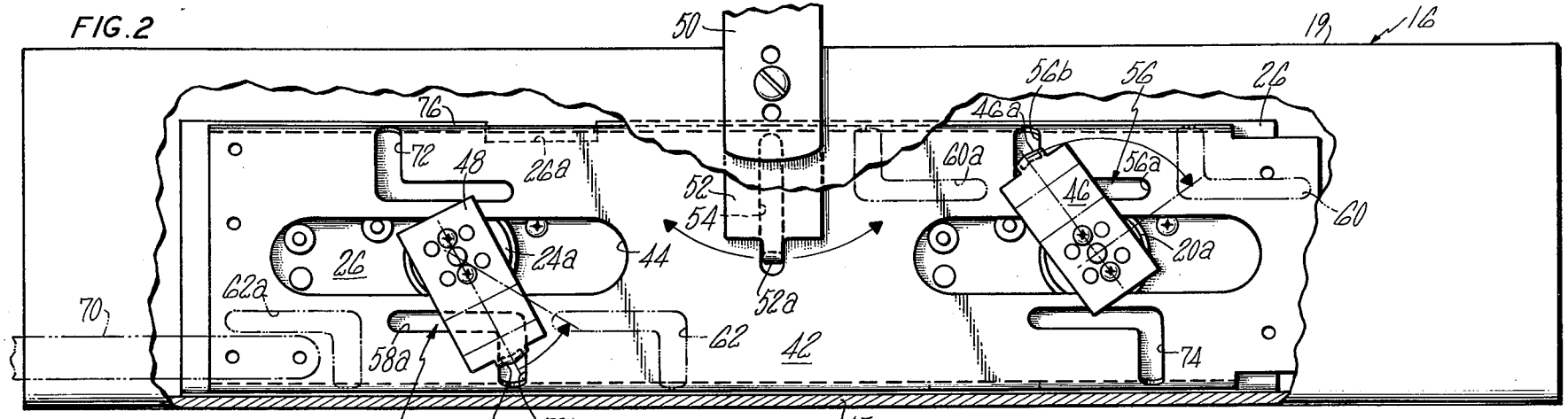
FIG. 2 is a side elevational view, partially broken away, of the transfer switching apparatus of FIG. 1.
Figure 3:
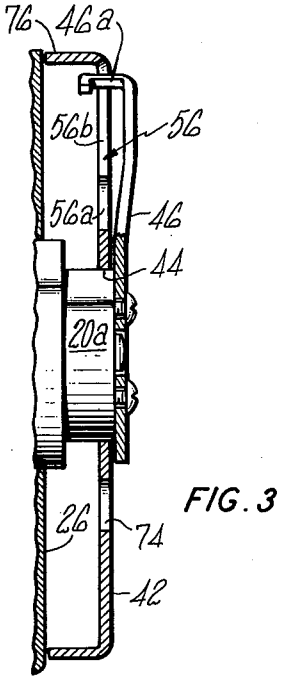
FIG. 3 is a sectional view taken along line 3—3 of FIG. 2.

Interconnecting the operating mechanisms of switches 10, 12 is an elongated operating slide 42, best seen in FIG. 2. This slide is provided with a pair of oblong openings 44 through which hubs 20*a* and 24*a* respectively associated with quick-make, quick-break mechanisms 20 and 24 extend pursuant to mounting the slide for longitudinal reciprocating movement (FIG. 3). A crank arm 46 is affixed to the butt end of hub 20*a*, while a similar crank arm 48 is affixed to the butt end of hub 24*a*. Slide 42 is thus loosely captured between these crank arms and mounting pan flange 26, while being guided thereby in its reciprocating movement. To reciprocate the slide, an exterior handle 50 is pivotally mounted to enclosure sidewall 19. An arm 52, rigidly connected to handle 50 and extending along the inside of enclosure sidewall 19, terminates in a turned-in tab 52*a* which is lodged in a transversely elongated slot 54 formed in slide 42. It is thus seen that pivoting of the handle 50 is effective to longitudinally reciprocate slide 42.

To translate slide reciprocation to articulation of switches 10, 12, the free ends of arms 46, 48 carry laterally turned tabs or pins 46*a*, 48*a*, respectively, which are received in associated L-shaped slots 56, 58 formed in the slide (FIG. 3). As seen in FIG. 2, each of these slots includes a longitudinally elongated slot segment 56*a*, 58*a* and a transversely elongated slot segment 56*b*, 58*b*.

In the intermediate or neutral slide position shown in FIG. 2, both switches are in their open circuit or OFF conditions. It is seen that pins 46*a*, 48*a* are located in the transverse segments of their associated slots. As handle 50 is swung counterclockwise, slide 42 is moved to the right as seen in FIG. 2. Pin 46*a*, engaged and moving in transverse slot segment 56*b*, translates the rightward slide movement into clockwise cranking movement of arm 46 with the result that switch 10 is articulated to its closed circuit or ON condition. On the other hand, pin 48*a* engaged in its transverse slot segment, causes crank arm 48 to be cranked in the counterclockwise direction through a minor arc during initial rightward movement of slide 42. This counterclockwise cranking of arm 48 rotates the operating mechanism of switch 12 further in its OFF direction, and thus this switch remains in its open circuit condition. For the concluding increment of rightward slide movement, pin 48*a* moves out of transverse slot segment 58*b* into longitudinal slot segment 58*a* where it progresses through to the blind end thereof without imparting cranking movement to arm 48. At the conclusion of the rightward slide movement L-shaped slots 56, 58 are in the phantom line positions indicated at 60 and 62, respectively. Pin 46*a* is still located in transverse slot segment 56*b* just above its junction with longitudinal slot segment 56*a*, while pin 48*a* is located at the blind end of its longitudinal slot segment 58*a*.

It is apparent that returning slide 42 to the left back to its neutral position shown in FIG. 2 causes arm 46 to be cranked counterclockwise, articulating switch 10 to its open circuit condition, while the operating mechanism for switch 12 is idled as pin 48*a* moves through its longitudinal slot segment 58*a*. Just prior to the arrival of the slide at its neutral position, pin 48*a* moves down into its transverse slot 58*a*, resulting in the cranking of arm 48 in the clockwise direction. This clockwise cranking of arm 48, though in the ON direction for switch 12, is of insufficient throw to articulate this switch to its closed circuit condition. It is also apparent that pivoting the handle 50 in the clockwise direction induces leftward movement of slide 42 with the L-shaped slots ultimately assuming their phantom line positions indicated at 60*a* and 62*a*. This leftward slide movement, in turn, induces clockwise cranking of arm 48 as its pin 48*a* moves through transverse slot segment 56*b* and results in switch 12 being articulated to its closed circuit or ON condition. Pin 46*a* moves out of its transverse slot segment and through to the blind end of its longitudinal slot segment, with the result that the operating mechanism for switch 10 is simply idled and its contacts remain open. Return of slide 42 from its left-most position to its neutral position articulates switch 12 to its open circuit position without changing the open circuit condition of switch 10.

From the foregoing description, it is seen that it is physically impossible for both switches 10 and 12 to simultaneously assume their closed circuit conditions. The positioning of L-shaped slot 56 above one oblong opening 44, and L-shaped slot 58 below the other oblong opening, i.e., on opposite sides of the longitudinal centerline of slide 42, insures that the rotary operating mechanisms can only be cranked in opposite directions, regardless of the direction of slide movement. Thus, while the operating mechanism of one switch is being articulated in its ON direction, the operating mechanism of the other switch can only be articulated in its OFF direction. Obviously, this positioning of the L-shaped slots dictates that their transverse segments be located at relatively opposite ends of their longitudinal slot segments.

Depending on the circumstances, the transfer switching apparatus of the invention may be installed in an elevated or overhead position atop a pole or at ground level. In the case of a ground level installation, the utility feed is typically from above into the line terminals of switch 10. In the case of an overhead installation, the utility feed is typically from below. To facilitate wiring for an overhead installation the utility feed is typically terminated at the line terminals of the lower switch, and, if differently rated switches are used, the higher rated switch is located in the lower part of enclosure 16. Thus in the illustration of FIG. 1, the positions of switches 10 and 12 would be reversed. Also in an overhead installation, handle 50 is not readily reachable, and thus the handle is replaced by an elongated pole, illustrated in phamtom at 70 in FIG. 2, which is bolted to the lower end of slide 42 and extends downwardly through an opening in the bottom wall of enclosure 16. To maintain the same convention, i.e., upward slide movement turns the utility switch ON and downward slide movement turns the standby switch ON, the slide is provided with additional L-shaped slots, seen at 72 and 74 in FIG. 2. Arm 48 is switched 180° prior to attachment to hub 24*a*, and pin 48*a* at its free end is received in L-shaped slot 72. Similarly, arm 46 is switched 180° prior to attachment to hub 20*a*, and its pin 46*a* is received in L-shaped slot 74. Under these circumstances, it is seen that upward movement of slide 42 (rightward in FIG. 2) from its neutral position cranks arm 48 clockwise to turn switch 12 ON, while downward slide movement (leftward in FIG. 2) cranks arm 46 clockwise to turn switch 10 ON.

Figure 4:
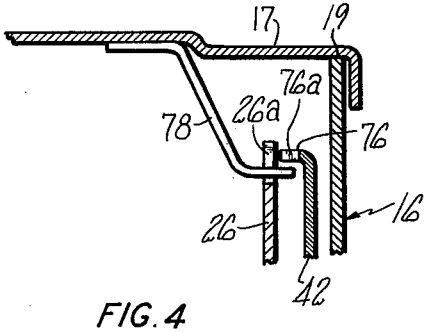
FIG. 4 is a fragmentary sectional view, which, taken in conjunction with FIG. 1, illustrates the door interlock feature of the present invention.

As an additional feature of the invention, slide 42 is uniquely structured to effect a simple interlocking function with enclosure door 17, such that the door can only be opened with the slide in its neutral position and both switches open. To this end, slide 42 is provided with a laterally turned front edge portion constituting an elongated flange 76 (FIGS. 1 and 4). This flange is notched as indicated at 76*a*, at an appropriate location such that it is vertically aligned with a door catch 78 when the slide is in its neutral position. Also vertically aligned with notch 76*a* in the neutral slide position is a relief 26*a* formed in the front edge of flange 26 carried by mounting pan 14 (FIGS. 1 and 4). It is thus seen that with the closure of door 17, catch 78 moves through notch 76*a* into relief 26*a*. Once slide 42 is shifted from its neutral position, slide flange 76 moves into overlying relation with catch 78 to prevent the opening of door 17.

It will thus be seen that the objects set forth above, among those made apparent in the preceding description, are efficiently attained and, since certain changes may be made in the above construction without departing from the scope of the invention, it is intended that all matter contained in the above description or shown in the accompanying drawings shall be interpreted as illustrative and not in a limiting sense.

Having described our invention, what we claim as new and desire to secure by Letters Patent is:

1. Transfer switching apparatus for switching an electrical load between alternative sources of electrical power, said transfer switching apparatus comprising, in combination:

A. an enclosure;

B. a first switch mounted within said enclosure and having a first rotary operating mechanism;

C. a first pin carried eccentrically by said first operating mechanism;

D. a second switch mounted within said enclosure and having a second rotary operating mechanism;

E. a second pin carried eccentrically by said second operating mechanism;

F. an elongated slide mounted within said enclosure for longitudinal reciprocating motion through an intermediate neutral position; and G. means forming in said slide first and second L-shaped slots in which said first and second pins are respectively accommodated, each said slot including a longitudinally extending slot segment and a transversely elongated slot segment.

1. with said slide in its neutral position, said first and second pins being located in said transverse slot segments of their associated first and second slots and said first and second switches being in their OFF conditions, 2. upon movement of said slide from its neutral position in one direction, said first pin moves solely in its transverse slot segment causing rotation of said first rotary operating mechanism to convert said first switch to its ON condition, while said second pin moves out of its transverse slot segment and through its longitudinal slot segment to idle said second operating mechanism leaving said second switch in its OFF condtion, and 3. upon movement of said slide from its neutral position in the opposite direction, said second pin moves solely in its transverse slot segment causing rotation of said second rotary operating mechanism to convert said second switch to its ON condition, while said first pin moves out of its transverse slot segment and through its longitudinal slot segment to idle said first operating mechanism leaving said first switch in its OFF condition.

2. The transfer switching apparatus defined in claim 1, which further includes:

A. means forming first and second aligned, longitudinally elongated openings in said slide, 1. said first and second rotary operating mechanisms each including hub portions extending respectively through said first and second openings pursuant to mounting said slide for reciprocating movement.

3. The transfer switching apparatus defined in claim 1, which further includes:

A. a door for said enclosure;

B. a catch carried by said door; and

C. means carried by said slide engaging said catch to preclude opening said door while slide is in any position other than its neutral position.

4. The transfer switching apparatus defined in claim 1, wherein said first and second L-shaped slots are located on opposite sides of the longitudinal centerline of said slide, whereby during initial slide movement away from said neutral position while said pins are moving in their respective transverse slot segments, said first and second operating mechanisms are actuated in opposite rotational directions such that while one switch is actuated in its ON direction the other switch is actuated in its OFF direction.

5. The transfer switching apparatus defined in claim 4 which further includes means forming in said slide third and fourth L-shaped slots identical to said first and second L-shaped slots, said third and fourth slots positioned relative to said first and second slots such that, upon respective receipt of said first and second pins therein, the directions of rotational actuation of said first and second operating mechanisms for a given direction of slide movement are reversed.

6. The transfer switching apparatus defined in claim 4, which further includes:

A. means forming first and second rotary operating mechanisms each including hub portions extending respectively through said first and second openings pursuant to mounting said slide for reciprocating movement.

7. The transfer switching apparatus defined in claim 4, which further includes:

A. a door for said enclosure;

B. a catch carried by said door; and

C. means carried by said slide engaging said catch to preclude opening said door while said slide is in any position other than its neutral position.

* * * * *